US009476604B1

(12) United States Patent
Mathews

(10) Patent No.: US 9,476,604 B1
(45) Date of Patent: Oct. 25, 2016

(54) ROOM HUMIDIFIER

(71) Applicant: Raymond D. Mathews, Raleigh, NC (US)

(72) Inventor: Raymond D. Mathews, Raleigh, NC (US)

( * ) Notice: Subject to any disclaimer, the term of this patent is extended or adjusted under 35 U.S.C. 154(b) by 0 days.

(21) Appl. No.: 15/193,550

(22) Filed: Jun. 27, 2016

(51) Int. Cl.
*F24F 6/04* (2006.01)
*F24F 13/02* (2006.01)
*F24F 13/20* (2006.01)
*F24F 6/00* (2006.01)

(52) U.S. Cl.
CPC ..... *F24F 6/043* (2013.01); *F24F 13/0245* (2013.01); *F24F 13/20* (2013.01); *F24F 2006/008* (2013.01)

(58) Field of Classification Search
CPC ..... B01F 3/04085; F24F 6/043; F24F 2003/1617; F24F 13/0245; F24F 13/20; F24F 2006/008
USPC ..... 261/104, 107
See application file for complete search history.

(56) References Cited

U.S. PATENT DOCUMENTS 69,621 A * 10/1867 Boynton ..... F24F 6/04 261/104
220,695 A * 10/1879 Bean ..... B01J 19/32 261/102
310,116 A * 12/1884 Beale ..... F24F 6/04 237/78 R
872,330 A * 12/1907 Cunningham ..... F24F 6/04 126/113
888,393 A * 5/1908 Dunning ..... A61L 9/12 239/51.5
1,011,244 A * 12/1911 Puddington ..... F24F 6/04 261/107
1,163,657 A * 12/1915 Hadaway, Jr. ..... A61M 11/041 261/104
1,668,000 A * 5/1928 Bender ..... F24F 6/04 261/104
1,876,959 A * 9/1932 Kelsea ..... F24D 19/0082 239/44
1,887,242 A * 11/1932 Martinson ..... F24D 5/00 126/113
1,894,898 A * 1/1933 Trane ..... F24F 6/043 165/110
2,091,957 A * 9/1937 Boa ..... F24D 19/0082 237/78 R
2,138,709 A * 11/1938 Rainbolt ..... F24F 6/04 261/104
2,161,001 A 6/1939 Bedol
2,164,763 A * 7/1939 Buck ..... F24F 6/04 261/107

(Continued)

FOREIGN PATENT DOCUMENTS

CA 2738326 A1 10/2012
JP 6-34171 * 2/1994

OTHER PUBLICATIONS

"Rags", Wikipedia, https://en.wikipedia.org/wiki/Microfiber, Apr. 18, 2016.

(Continued)

*Primary Examiner* — Charles Bushey
(74) *Attorney, Agent, or Firm* — James G. Passé; Passé Intellectual Property, LLC

(57) ABSTRACT

The present invention relates to an unpowered room humidifier utilizing mechanically blowing air from a register, wherein water is wicked into a plurality of absorbent cloths draped over a plurality of beams and results in increased humidity as the air leaves the humidifier.

14 Claims, 6 Drawing Sheets

(56) References Cited

U.S. PATENT DOCUMENTS 2,494,640 A * 1/1950 Abbott ..... B05B 7/04 261/104
2,749,725 A * 6/1956 Essman et al. ..... F25D 21/14 261/104
3,227,064 A * 1/1966 Spangle ..... F24D 5/00 237/78 R
3,400,919 A * 9/1968 Schall ..... F24F 6/04 126/113
4,226,174 A 10/1980 Vesper
4,307,656 A 12/1981 Vesper
4,706,552 A 11/1987 Maguire
5,324,230 A * 6/1994 Hist ..... F24F 6/043 454/328
5,403,233 A * 4/1995 Daneshvar ..... F24F 6/043 237/78 R
7,828,275 B2 * 11/2010 Won ..... F24F 6/043 261/104

OTHER PUBLICATIONS

"Breathe Easy II—Non-Electric Room Humidifier", Vesper Research website, http://www.vesperresearch.com/pet_health.htm, Apr. 18, 2016.

* cited by examiner

ROOM HUMIDIFIER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to an evaporative room humidifier. More particularly, it relates to the type of non-powered room evaporative humidifiers that are adapted to be used with the blowing air from a standard furnace wall or floor register or the like.

2. Description of Related Art

The general idea of having a humidifier used in conjunction with a source of blowing air, like from a home furnace register, is well known and has been utilized since at least the early 1960's. In general, these devices are placed at the furnace, as a replacement for the register, or collect air from the register by sitting on/by the register and letting the register air, especially warm air, circulate through or past a series of rigid evaporator plates dipped in a water tank. This style of humidifier utilizes a series of fixed rigid plate-type evaporators locked into place so that the air can pass by the plate and pick up moisture before being expelled into the room.

These type of humidifies work without power of any kind, making them popular and attractive as a low cost method of humidifying air, especially compared to electric powered devices. However, it is also well known that these types of devices are very poor at adding humidity to the air, regardless of the water tank size utilized with them. In addition, there is a series of problems with using evaporator plates as the wicking medium. Evaporator plates are rigid and not very absorptive (usually made of cellulosic fiber or fiberglass, etc.), slowing the wicking action and, thus, reducing the amount of water that is delivered to the air. They have a relatively low surface area, they clog quickly and are unclean-able, thus leading to the need for frequent replacement and rapidly decreasing efficiency of such devices utilizing evaporator plates over relatively short periods of time. Evaporator plates need to remain flat to be installed in most of these types of humidifiers, such that while they are rigid even a small amount of warping or damage to the edges renders them unusable. Finding a system which overcomes the difficulties with forced air humidifiers would be of great value.

BRIEF SUMMARY OF THE INVENTION

The problems associated with non-powered humidifiers is largely overcome with the present invention, which comprises cloths with high surface area in contact with the warm air, the cloths are easily washable and are high-wicking devices, with high humidification of as much as 4 to 8 times or more water-to-air transfer compared to similar unpowered prior art devices due to the large total water surface area in the path of incoming heated air, as well as larger water capacities and carry flexibility.

Accordingly, in one embodiment of the invention, there is an unpowered room humidifier, adapted to receive mechanically blowing air from a register, comprising:

a) a tank with a reservoir for placement of water;

b) an inlet opening positioned in the tank to receive blowing air from the register;

c) an outlet opening positioned in the tank to allow blowing air, received through the inlet opening, to pass through the tank and out the outlet opening;

d) a plurality of flexible absorptive cloths, each cloth positioned over a beam such that the first two sides of the cloth hang down on one side of the beam and the second two sides of the cloth hang on the other side of the beam, the beam adapted and positioned to hold the first two sides and the second two sides from touching and positioning the cloth sides parallel to the direction of the air blowing through the tank from the inlet opening to the outlet opening; and e) wherein, the cloth is positioned such that when water is placed in the tank, a bottom portion of the cloth is positioned in the water.

DETAILED DESCRIPTION OF THE INVENTION

Figure 1:
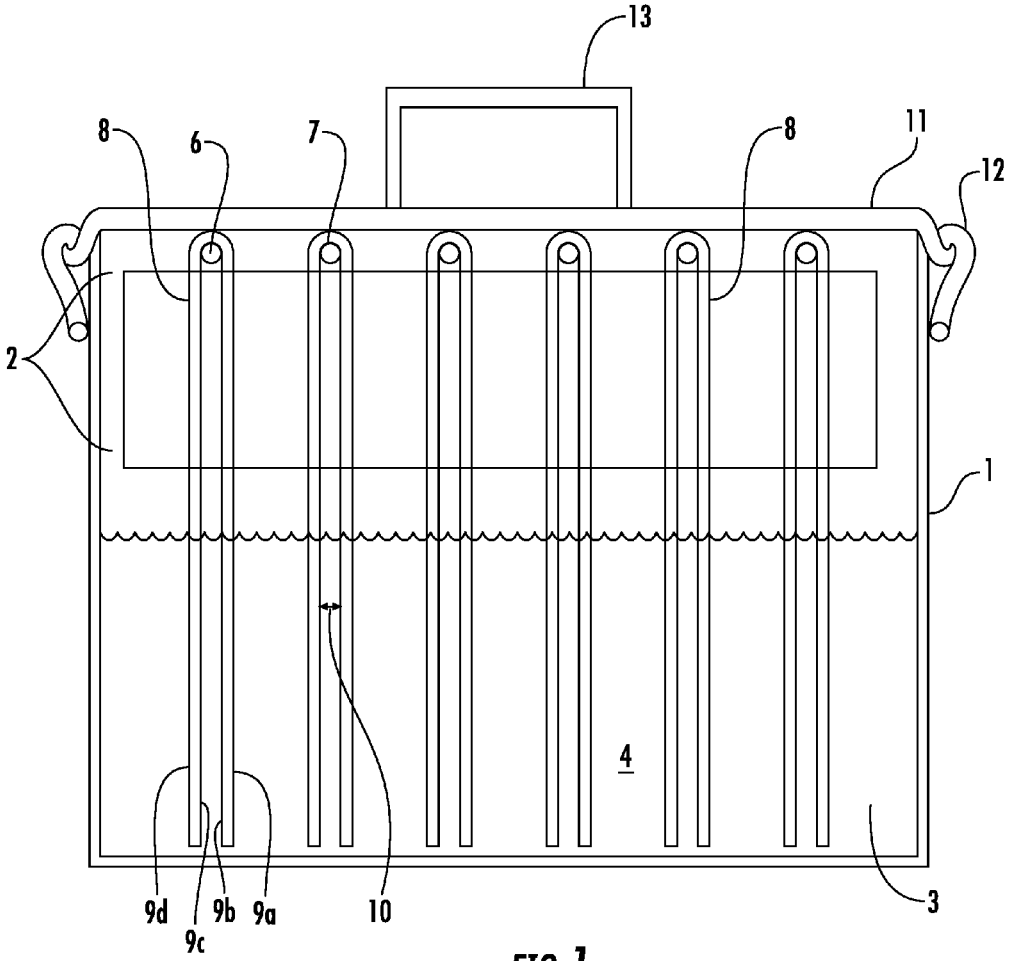
FIG. 1 is a front view of a room humidifier.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitations thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "unpowered room humidifier" refers to a device wherein mechanically blowing air from a room source, e.g. from an HVAC register, can enter it, pass over an evaporative device, and exit the device having increased the relative humidity. A register can be the exit of any device or source of mechanically blown air, such as portable heaters or fans but, in one embodiment, it refers to the HVAC registers found on the walls and floors of buildings that, via a fan, blow air that is either heated, air conditioned, or just room temperature. The device can be free standing, attached to the register, or the like, or can be positioned with a duct leading from the register to an inlet on the humidifier.

As used herein, the term "heating and cooling type register" refers to a standard HVAC register found in most homes and many businesses and is understood within the skill in the art.

As used herein, the term "tank with a reservoir" refers to the humidifier shaped to hold a certain quantity of water and the evaporative cloths used herein being positioned to dip into that water reservoir. The larger the tank reservoir, the more water it can hold, and the longer one can go without refilling the device. The present invention is so efficient compared to previous devices that, with only a limited amount of cloths, a large quantity of water can be introduced into the air, depending on the air flow rate, number of cloths, and the like. In one embodiment, the tank water capacity will be 240 cubic inches or 1.04 gallons.

As used herein, the term "inlet" refers to an opening in the device where blowing air from a register can enter.

As used herein, the term "outlet" refers to an opening in the humidifier where blowing air, having entered the inlet, can exit the device after passing over the flexible absorptive cloths.

As used herein, the term "flexible absorptive cloths" refers to a woven or non-woven fabric capable of holding at least its weight in water. Examples include "terry cloth" (washcloth type material, a pile fabric, usually of cotton, with uncut loops), and the like. It can be a flat piece of material which is draped over a beam or, in one embodiment, it is a ring of material, as shown in FIG. 3*b* and FIG. 6. Absorptive cloths have smaller fibers which make them more absorptive and flexible i.e. able to drape over the beam and dip down into the water in the tank reservoir. Cloth material has the advantage over previous evaporative plates in that it can be cleaned and reused several seasons before replacement. It also allows for a greater surface area than evaporative plates, allowing for improved evaporation and better humidification in a shorter period of time. By draping the cloth over the beam, there are four sides of the cloth exposed to the blowing air, thus increasing the evaporation surface area and evaporation rate.

As used herein, the term "beam" refers to a device used to provide support in a substantially horizontal context and, thus, carries a load along its longitudinal axis. It is designed to support a cloth draped over it. In as such, it can be a dowel rod or a beam of plastic. In general, support for the beam can be by any convenient means, such as having it supported by the walls, lips, floor, or the like of the humidifier. One skilled in the art can fashion the embodiments shown, as well as other devices within the skill in the art, based on the disclosure and drawings herein.

As used herein, the term "positioned over a beam" refers to how the cloths are positioned by draping, or the like, over the beam, such that the first two sides of the cloth hang down on one side of the beam, and the second two sides of the cloth hang on the other side of the beam, the beam adapted and positioned to hold the first two sides and second two sides from touching (see FIG. 1), and positioned with the sides parallel to the direction of the air blowing through the tank from the inlet to the outlet. This can easily be seen in the Figures where there is space between each of the first and second sides of the cloth draped over the beam. In addition, at least a portion of the bottom of the cloth (as shown in the Figures) is positioned in the water when there is water in the reservoir.

As used herein, the term "parallel to the direction of air blowing through the tank" refers to the cloths draped over the beam and positioned in the tank such that the air from the register entering the inlet of the humidifier is presented with an edge of the cloth, such that the air passes parallel to the four sides of the cloth hanging in the humidifier (see, e.g. FIG. 1 and FIG. 6).

As used herein, the term "lid" refers to any device used to secure, dose, and generally prevent inadvertent access to the top of the humidifier. It allows access for installing and removing the cloths, as well as the beams, and is convenient to add water to the reservoir.

As used herein, the term "handle" refers to one or more carry handles positioned to aid in carrying the humidifier from place to place e.g. from a sink to be filled, back to a register. In one embodiment, a handle is positioned on the top lid of the humidifier.

As used herein, the term "attach the humidifier to the register" refers to having some means for attaching in a removable fixed manner (e.g. by magnets) the air flow duct to the humidifier, and to prevent them from moving about, and/or keeping the inlet in connection with the register blowing air from the wall or floor. Other means could be utilized, but the device could also be just sitting on the floor or other device register.

Figure 2:
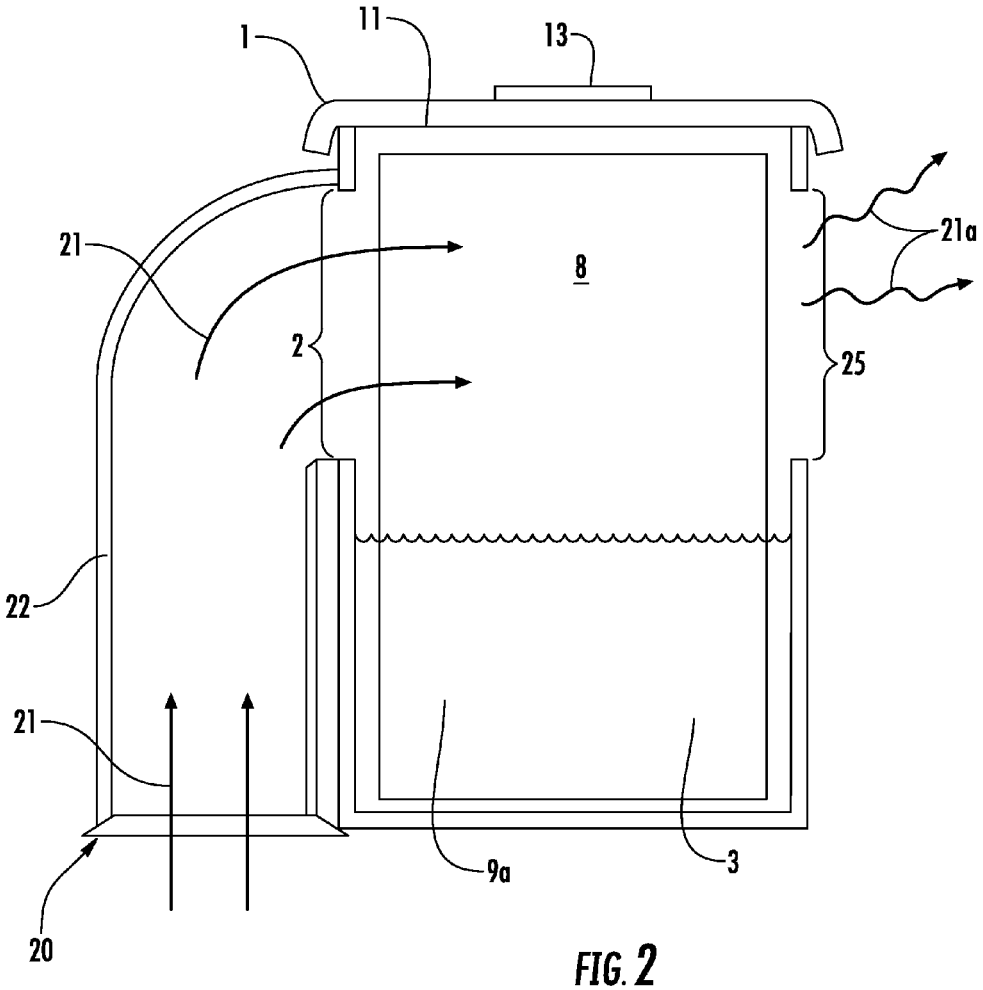
FIG. 2 is a side view of a humidifier in use with air from a register.

As used herein, the term "flow guides" refers to one or more devices positioned on a register which guides the blowing air from the register to the inlet opening in the humidifier, an example of which is shown in FIG. 2.

As used herein, the term "position the humidifier" refers to placement of the humidifier in such a manner that it receives blowing air through the inlet from the register. Design and placement of the opening could be shown, as shown in the figures, as an embodiment, but could be any place consistent with the description of the invention herein. In one embodiment, two humidifiers are utilized and a second humidifier positioned to receive outlet air from a first humidifier into the second humidifiers inlet (this can be seen in FIG. 5).

In use, the humidifier reservoir is filled with water to just below the bottom window opening and the cloths are positioned each on an individual beam and positioned in the humidifier with the edges of the cloths facing the opening. Two or more cloths are positioned in the humidifier and, in one embodiment, there are from about 5 to about 10 cloths positioned in each device.

DRAWINGS

Now referring to the drawings, FIG. 1 is a front view of the present invention. Non-powered humidifier 1 is shown as a clear container embodiment. The humidifier 1 comprises a front with an inlet opening 2. Inside the humidifier can be seen water 3 in reservoir 4. In this view there are six beams 7 (dowel rods) positioned from front to back so that only an end 6 of beam 7 is seen. On each beam 7 there is a cloth 8 draped over the beam 7 in which a first two sides 9*a* and 9*b* and the second two sides 9*c* and 9*d* of the cloth 8 are positioned in water 3 so that the cloth will wick the water up into the cloth to all the area above water 3. It can be seen in this view that each cloth presents four sides to the incoming air: 9*a*, 9*b*, 9*c*, and 9*d*, and that the beam 7 holds each of the first two sides (9*a* and 9*b*) and second two sides (9*c* and 9*d*) apart. The space 10 between sides 9*c* and 9*b* presents two of the four sides of each cloth to the blowing air entering the inlet opening 2. The humidifier has lid 11 which latches 12 on a top of the humidifier 1 and is also fitted with a carry handle 13.

FIG. 2 shows the humidifier 1 positioned on a floor next to an HVAC register 20 in order to receive mechanically blowing air 21, in this case, via duct 22. The mechanically blowing air 21 enters inlet opening 2, moves past cloth 8 picking up moisture wicking up from water 3 into the cloth 8 before blowing out outlet 25 as humidified air 21*a*.

Figure 3A:
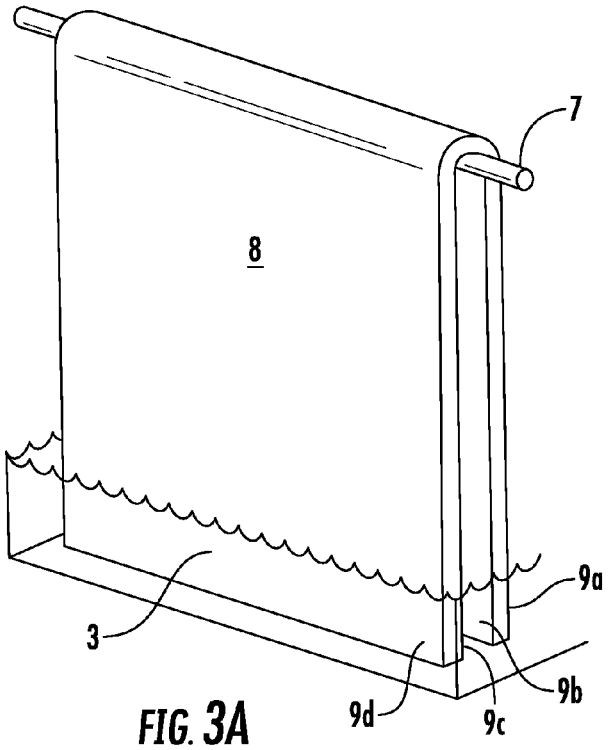
FIG. 3*a* is a cloth hung by a rod or beam.
Figure 3B:
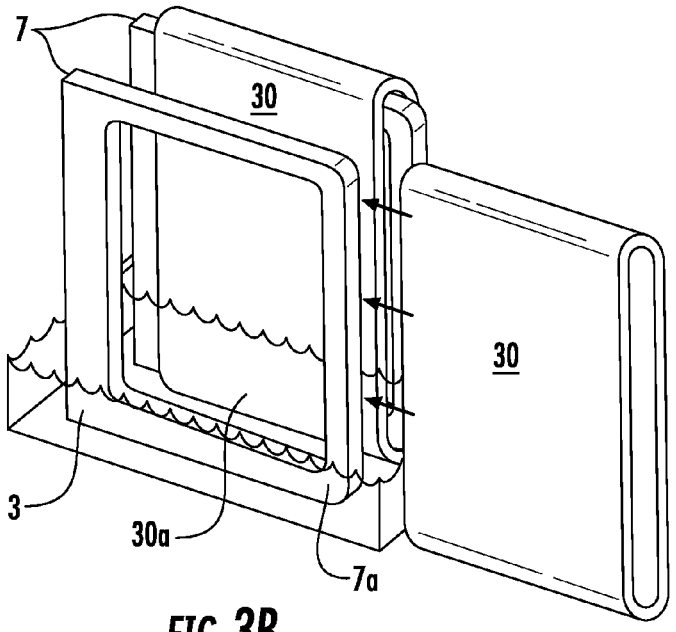
FIG. 3*b* is a cloth ring supported by an upper and lower beam.

FIG. 3*a* shows a perspective view of one embodiment of a cloth 8 draped over beam (dowel rod) 7. Water 3 is shown with all four sides (9*a*, 9*b*, 9*c*, and 9*d*) of the cloth 8 positioned in water 3. FIG. 3*b* shows a cloth ring 30 that is one continuous loop where lower portion 30*a* is positioned in water 3, i.e. all four sides are in the water, being held in the water by lower beam support 7*a*.

Figure 4:
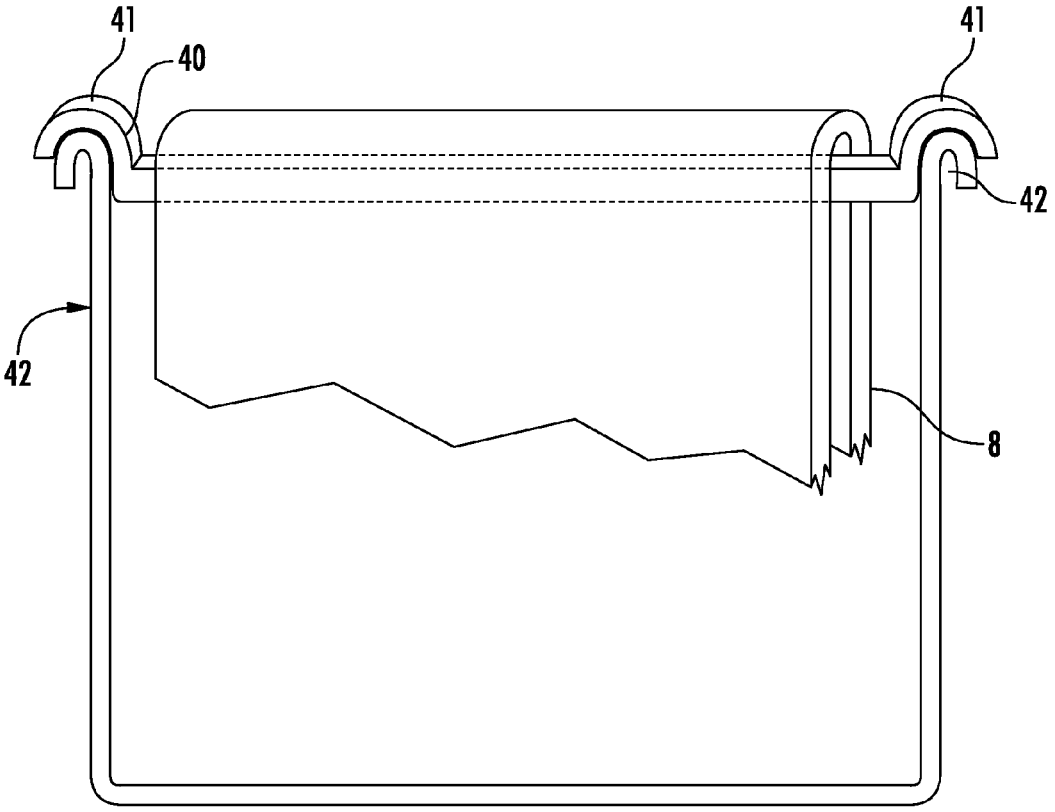
FIG. 4 is another embodiment of a beam supported at both ends.

FIG. 4 is a side view of plastic beam 40 with hook ends 41 resting on a tank wall top edge 42 for support.

Figure 5:
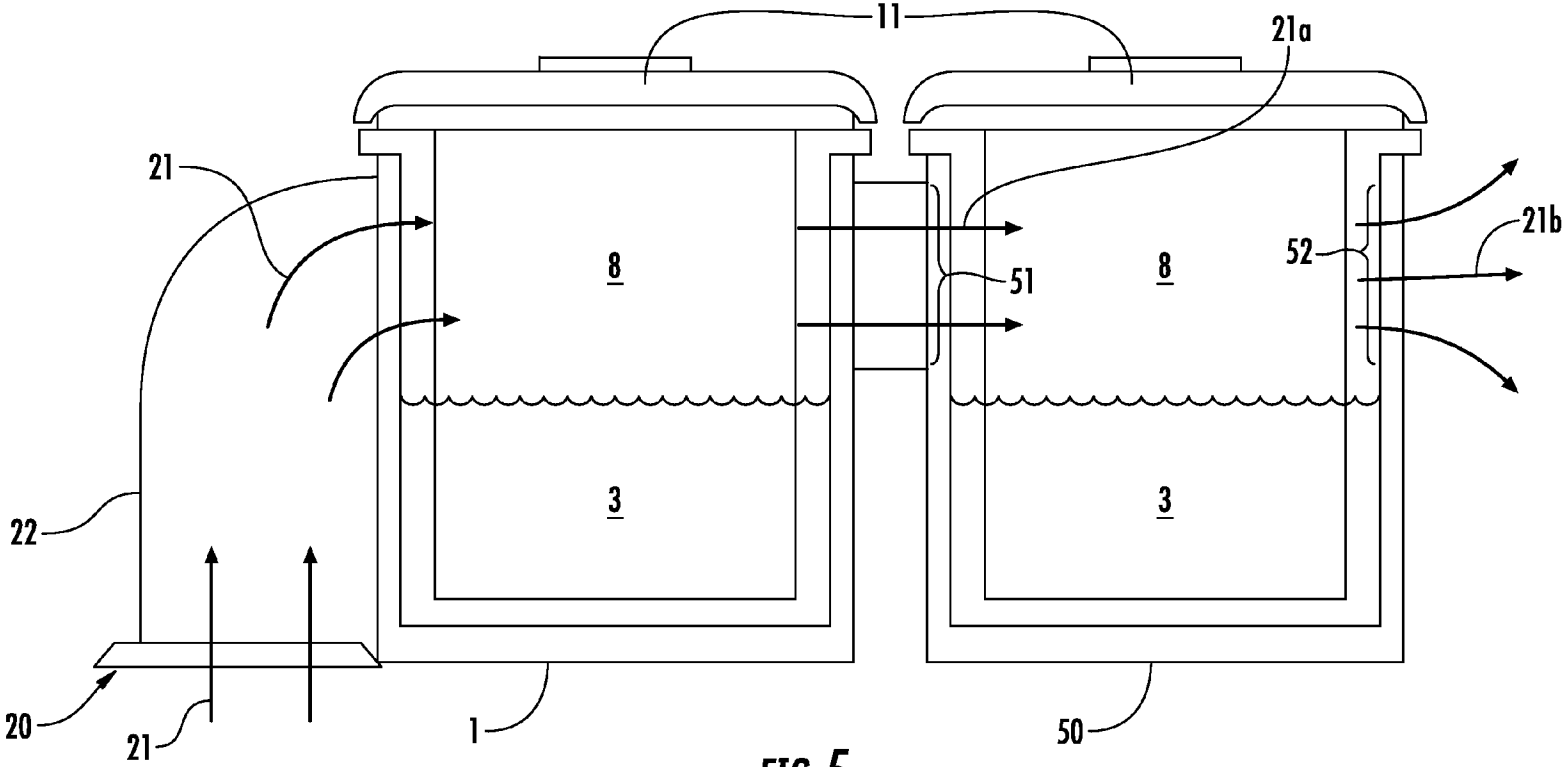
FIG. 5 is a side view of a dual humidifier set up.

FIG. 5 is a side view of an embodiment where a second humidifier 50 is positioned in aligned connection with the first humidifier 1 such that moisturized air 21*a* from the first humidifier 1 enters second humidifier 50 through inlet 51 and exits via outlet 52 to produce hyper humidified air 21*b*.

Figure 6A:
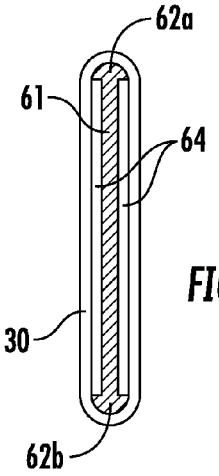
FIG. 6*a* is a section view of a cloth ring on a two-beam plate.
Figure 6B:
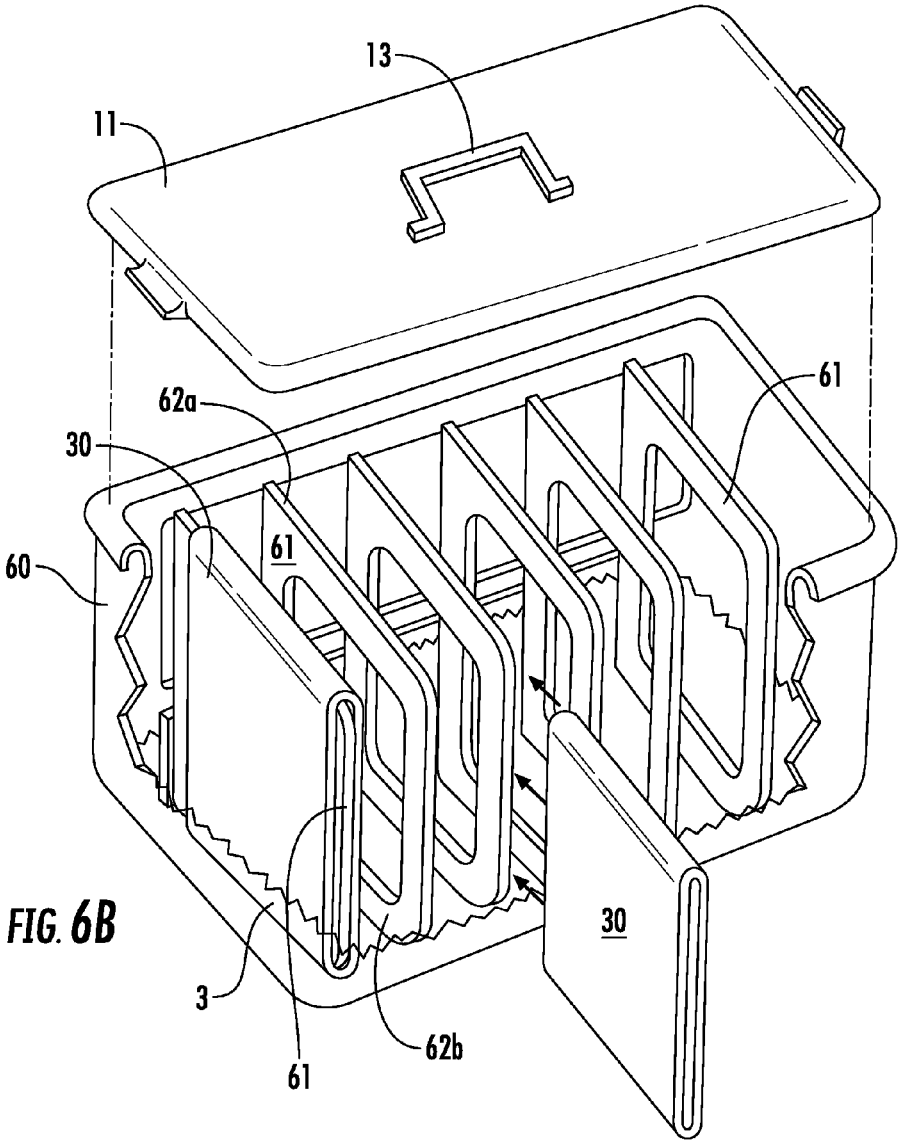
FIG. 6*b* is a perspective of a cloth ring on a two-beam plate in a humidifier and in the water.

FIG. 6*b* is a perspective embodiment of the present invention humidifier 60. In this view, cloth ring 30 is mounted on beam plate 61, having a top beam 62*a* and a bottom beam 62*b*, for draping the cloth ring 30 on. As can be seen, the top beam 62*a* of the beam plate 61 acts as the other beams in the invention, but because of the ring nature of the cloth 30 the plate 61 can hold the whole cloth while holding the bottom end of the cloth 30*a* in water 3 on bottom beam 62*b*. FIG. 6*a* is a section view of plate 61 showing the cloth ring 30 wrapped around the top 62*a* and bottom 62*b* with space 64 where heated air can flow between the inside cloth surfaces and the beam 61.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art can be made, but these changes still fall within the scope of the invention as claimed by the applicant.

What is claimed is:

1. A portable, unpowered room humidifier, adapted to receive mechanically blowing air from a register without attachment to the register, comprising:

a) a tank with a reservoir for placement of water;

b) an inlet opening positioned in the tank on a first side to receive blowing air from the register without attachment to the register;

c) an outlet opening positioned in the tank on a second side to allow blowing air, received through the inlet opening on the first side, to pass through the tank and out the outlet opening, the second side positioned on a side of the tank opposite the first side;

d) a plurality of flexible absorptive cloths, each cloth positioned over a beam such that the first two sides of the cloth hang down on one side of the beam and the second two sides of the cloth hang on the other side of the beam, the beam adapted and positioned to hold the first two sides and the second two sides from touching and positioning the cloth sides parallel to the direction of the air blowing through the tank from the inlet opening to the outlet opening; and e) wherein, the cloth is positioned such that when water is placed in the tank, a bottom portion of the cloth is positioned in the water.

2. The humidifier according to claim 1 wherein the cloth is a cotton fiber.

3. The humidifier according to claim 1 wherein the beam is a dowel.

4. The humidifier according to claim 1 wherein the beam is a plastic arm.

5. The humidifier according to claim 1 wherein there is a latching lid on top of the tank for addition of water, beams and cloths and for cleaning the tank.

6. The humidifier according to claim 1 wherein there is a handle on top of the tank lid.

7. The humidifier according to claim 1 which additionally comprises a flow duct which guides air from the register to the inlet opening.

8. The humidifier according to claim 7 wherein there are magnets positioned to attach the air flow duct to the register.

9. The humidifier according to claim 1 wherein the tank is adapted to hold five or more cloths.

10. The humidifier according to claim 1 wherein the humidifier is positioned to receive mechanically blowing air from a register.

11. The humidifier according to claim 10 wherein a second humidifier is positioned with its inlet positioned to receive air coming from the outlet of the other humidifier.

12. The humidifier according to claim 1 wherein the cloth is a cloth ring.

13. The humidifier according to claim 12 wherein a cloth ring is adapted to fit on a dual-beam plate, and the beam plate is adapted to fit in an unpowered room humidifier.

14. The cloth ring according to claim 13 which has been mounted on the beam plate.

* * * * *